US012416136B2

(12) United States Patent
Nishihara et al.

(10) Patent No.: US 12,416,136 B2
(45) Date of Patent: Sep. 16, 2025

(54) SYSTEM AND METHOD FOR CONTROLLING WORK MACHINE

(71) Applicant: KOMATSU LTD., Tokyo (JP)

(72) Inventors: Ken Nishihara, Tokyo (JP); Eiji Ishibashi, Tokyo (JP)

(73) Assignee: KOMATSU LTD., Tokyo (JP)

( * ) Notice: Subject to any disclaimer, the term of this patent is extended or adjusted under 35 U.S.C. 154(b) by 47 days.

(21) Appl. No.: 18/577,759

(22) PCT Filed: Jul. 27, 2022

(86) PCT No.: PCT/JP2022/028966

§ 371 (c)(1),
(2) Date: Jan. 9, 2024

(87) PCT Pub. No.: WO2023/047793

PCT Pub. Date: Mar. 30, 2023

(65) Prior Publication Data

US 2024/0318408 A1 Sep. 26, 2024

(30) Foreign Application Priority Data

Sep. 22, 2021 (JP) ..... 2021-154046

(51) Int. Cl.
*E02F 9/26* (2006.01)
*E02F 9/22* (2006.01)

(52) U.S. Cl.
CPC ..... *E02F 9/26* (2013.01); *E02F 9/264* (2013.01); *E02F 9/2203* (2013.01)

(58) Field of Classification Search
CPC . E02F 9/26; E02F 9/264; E02F 9/2203; E02F 9/265; E02F 3/841
See application file for complete search history.

(56) References Cited

U.S. PATENT DOCUMENTS 9,988,787 B1 * 6/2018 Wang ..... G01S 19/53
2009/0254279 A1 * 10/2009 Han ..... G01C 21/265 701/501

(Continued)

FOREIGN PATENT DOCUMENTS

| | | | |
|---|---|---|---|
| JP | 2020-51200 | A | 4/2020 |
| JP | 2020-133235 | A | 8/2020 |
| WO | 2017/072877 | A1 | 5/2017 |

OTHER PUBLICATIONS

The International Search Report for the corresponding international application No. PCT/JP2022/028966, issued on Oct. 4, 2022.

*Primary Examiner* — Russell Frejd
(74) *Attorney, Agent, or Firm* — GLOBAL IP COUNSELORS, LLP

(57) ABSTRACT

The system includes a vehicle body sensor attached to a vehicle body of a work machine, a work implement sensor attached to a work implement of the work machine to detect a roll angle of the work implement, and a controller communicably connected to the sensors. The vehicle body sensor detects roll, pitch, and yaw angles of the vehicle body. The controller acquires the roll and pitch angles of the vehicle body detected by the vehicle body sensor, acquires the roll angle of the work implement detected by the work implement sensor, calculates a yaw angle error of the vehicle body sensor with respect to the vehicle body based on the pitch angle of the vehicle body and a difference between the roll angle of the vehicle body and the roll angle of the work implement, and calibrates the vehicle body sensor using the yaw angle error.

6 Claims, 8 Drawing Sheets

(56) References Cited

U.S. PATENT DOCUMENTS

| | | | | |
|---|---|---|---|---|
| 2016/0116500 | A1* | 4/2016 | Kida | G01P 21/00 73/1.37 |
| 2018/0171598 | A1 | 6/2018 | Iwamura et al. | |
| 2021/0148093 | A1 | 5/2021 | Shimada | |
| 2022/0081879 | A1 | 3/2022 | Harada et al. | |
| 2022/0170239 | A1* | 6/2022 | Kean | E02F 9/205 |

* cited by examiner

SYSTEM AND METHOD FOR CONTROLLING WORK MACHINE

CROSS-REFERENCE TO RELATED APPLICATIONS

This application is a U.S. National stage application of International Application No. PCT/JP2022/028966, filed on Jul. 27, 2022. This U.S. National stage application claims priority under 35 U.S.C. § 119(a) to Japanese Patent Application No. 2021-154046, filed in Japan on Sep. 22, 2021, the entire contents of which are hereby incorporated herein by reference.

BACKGROUND

Technical Field

The present invention relates to a system and a method for controlling a work machine.

Background Information

Some work machines include a sensor for detecting a posture of the work machine. For example, the work machine disclosed in Japanese Patent Application Publication No. 2020-133235 includes a vehicle body, a work implement attached to the vehicle body, and a posture sensor. The posture sensor is attached to the vehicle body. The posture sensor detects a pitch angle and a roll angle of the vehicle body indicative of a posture of the vehicle body.

SUMMARY

In order to accurately detect a roll angle and a pitch angle of the vehicle body with the posture sensor described above, the posture sensor needs to be attached to the vehicle body so that a yaw angle of the posture sensor matches a yaw angle of the vehicle body. That is, a front direction of the posture sensor needs to match a front direction of the vehicle body. However, if the yaw angle of the posture sensor is deviated from the yaw angle of the vehicle body due to an attachment error of the posture sensor, an error occurs in the roll angle and the pitch angle of the vehicle body detected by the posture sensor on a slope.

Methods for calibrating such error in the posture sensor include, for example, a following method. First, a work machine is disposed on a slope whose inclination angle is known. At this time, the work machine is disposed so that an orientation of the work machine is aligned with a direction of the slope. If the yaw angle of the posture sensor does not deviate from the yaw angle of the vehicle body, the roll angle of the vehicle body of the work machine is zero degrees in this state.

Accordingly, when the roll angle of the vehicle body is not zero, an error occurs in the roll angle due to a yaw angle error of the posture sensor. Therefore, the yaw angle error of the posture sensor can be acquired by calculating the yaw angle of the vehicle body at which the roll angle of the vehicle body detected by the posture sensor is zero in the above state.

However, the above calibration method requires a slope whose inclination angle is known. Therefore, equipment for performing calibration or topography is restricted. Moreover, the work machine needs to be disposed on a slope so that an orientation of the work machine is aligned with the direction of the slope accurately. It is difficult and time-consuming to operate the work machine in such a precise manner. An object of the present invention is to provide a system and a method for controlling a work machine with fewer restrictions on equipment for performing calibration.

A system according to one aspect of the present invention is a system for controlling a work machine. The work machine includes a vehicle body and a work implement. The work implement is supported by the vehicle body. The system includes a vehicle body sensor, a work implement sensor, and a controller. The vehicle body sensor is attached to the vehicle body. The vehicle body sensor detects a roll angle, a pitch angle, and a yaw angle of the vehicle body. The work implement sensor is attached to the work implement. The work implement sensor detects a roll angle of the work implement.

The controller acquires the roll angle and the pitch angle of the vehicle body detected by the vehicle body sensor. The controller acquires the roll angle of the work implement detected by the work implement sensor. The controller calculates a yaw angle error of the vehicle body sensor with respect to the vehicle body based on the pitch angle of the vehicle body and a difference between the roll angle of the vehicle body and the roll angle of the work implement. The controller calibrates the vehicle body sensor using the yaw angle error of the vehicle body sensor.

A method according to another aspect of the present invention is a method performed by a controller that controls a work machine. The work machine includes a vehicle body, a work implement, a vehicle body sensor, and a work implement sensor. The work implement is supported by the vehicle body. The vehicle body sensor is attached to the vehicle body. The vehicle body sensor detects a roll angle, a pitch angle, and a yaw angle of the vehicle body. The work implement sensor is attached to the work implement. The work implement sensor detects a roll angle of the work implement.

The method includes acquiring the roll angle and the pitch angle of the vehicle body detected by the vehicle body sensor, acquiring the roll angle of the work implement detected by the work implement sensor, calculating a yaw angle error of the vehicle body sensor with respect to the vehicle body based on the pitch angle of the vehicle body and a difference between the roll angle of the vehicle body and the roll angle of the work implement, and calibrating the vehicle body sensor using the yaw angle error of the vehicle body sensor.

According to the present invention, the yaw angle error of the vehicle body sensor is calculated using the difference between the roll angle of the work implement detected by the work implement sensor and the roll angle of the vehicle body detected by the vehicle body sensor. As a result, the vehicle body sensor can be accurately calibrated even on a slope whose inclination angle is unknown or even if the orientation of the vehicle body does not exactly match the direction of the slope. Therefore, according to the present invention, restrictions on equipment for performing calibration can be reduced. Also, the time for calibration can be reduced.

DETAILED DESCRIPTION OF EMBODIMENT(S)

Figure 1:
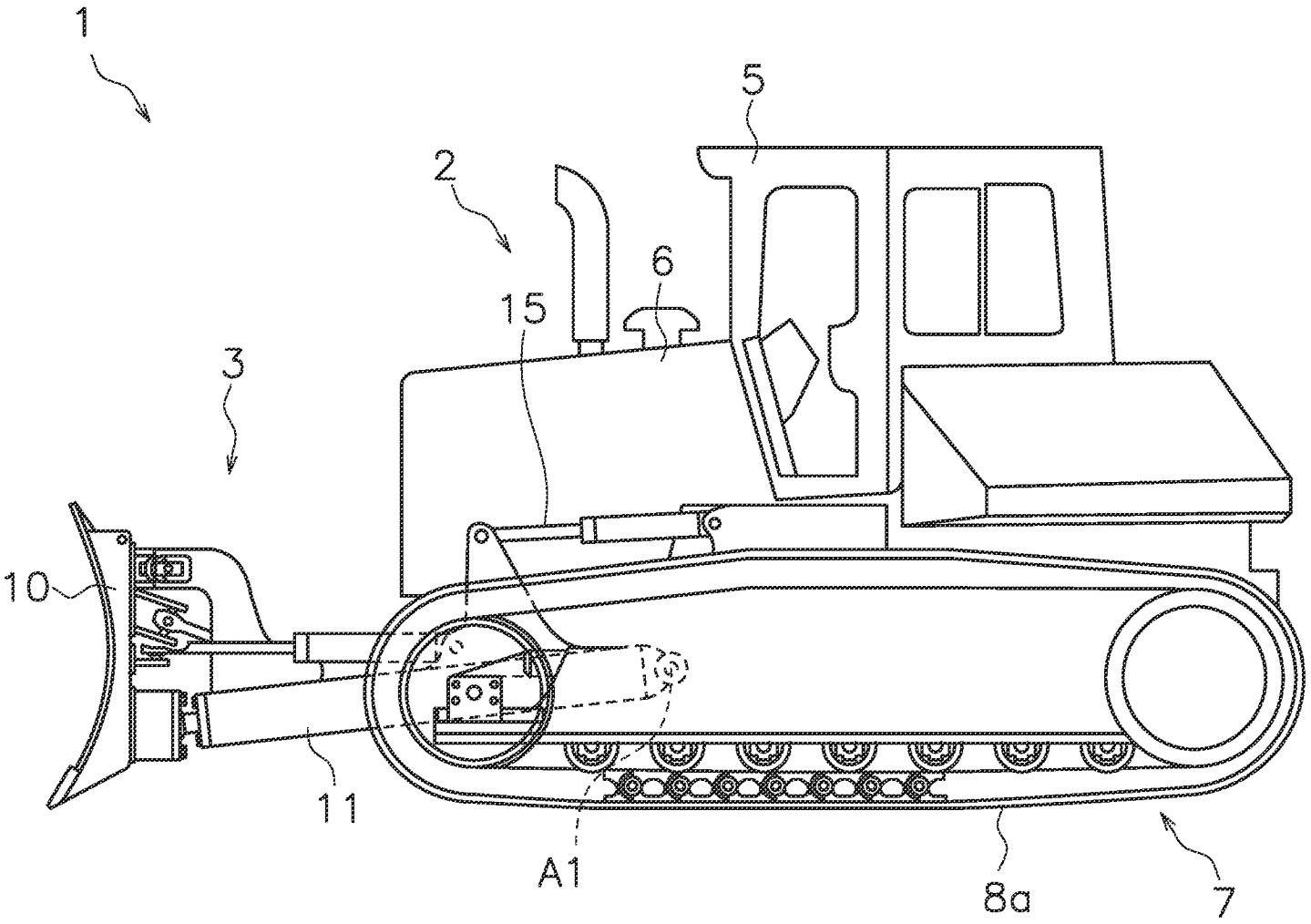
FIG. 1 is a side view of a work machine according to an embodiment.
Figure 2:
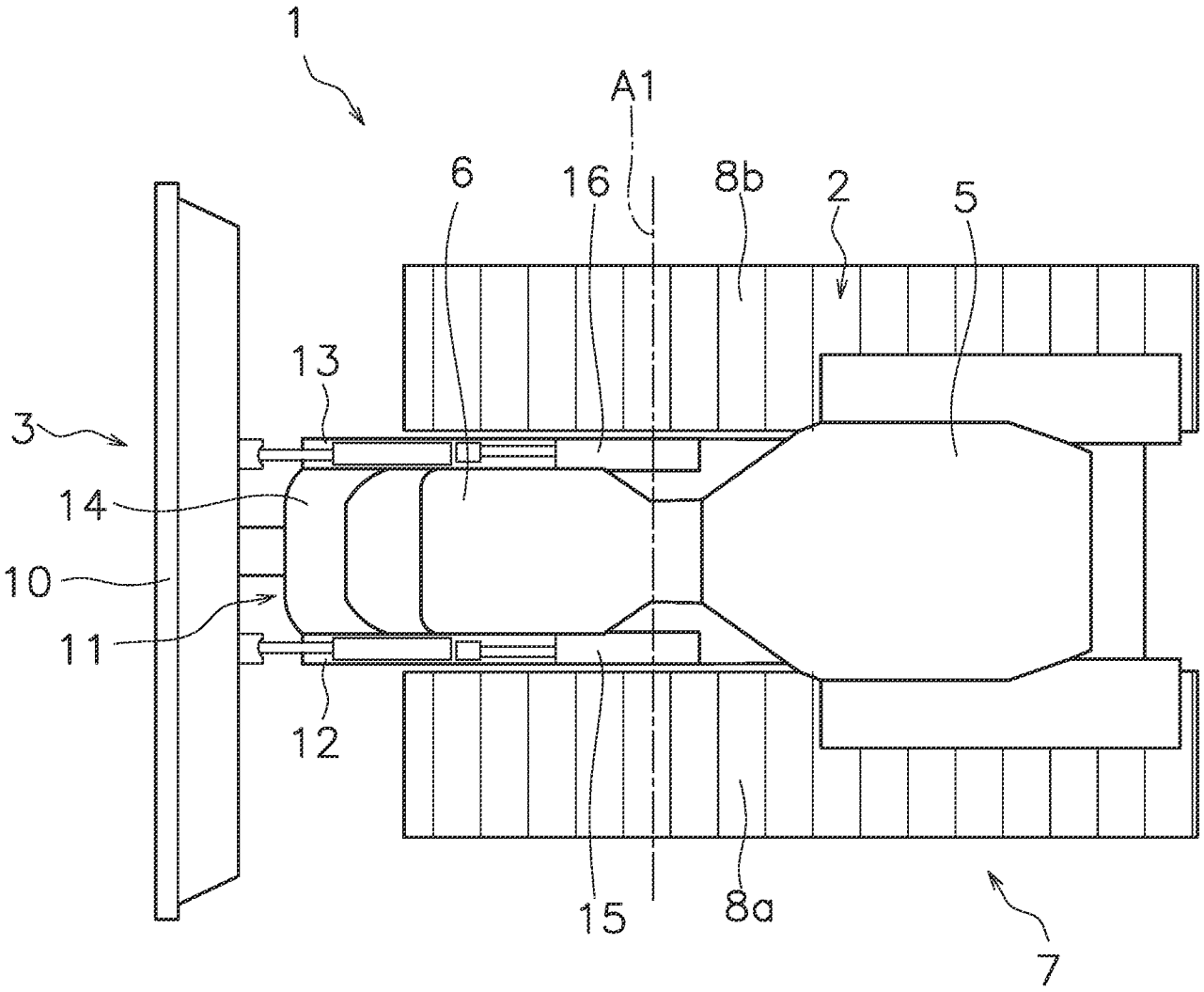
FIG. 2 is a top view of the work machine.

Hereinafter, a work machine according to an embodiment will be described with reference to the drawings. FIG. 1 is a side view of a work machine 1 according to the embodiment. FIG. 2 is a top view of the work machine 1. The work machine 1 according to the present embodiment is a bulldozer. The work machine 1 includes a vehicle body 2 and a work implement 3.

The vehicle body 2 includes an operating cabin 5, a power compartment 6, and a travel device 7. An operator's seat that is not illustrated is disposed in the operating cabin 5. The power compartment 6 is disposed in front of the operating cabin 5. The travel device 7 supports the vehicle body 2. The travel device 7 includes left and right crawler belts 8*a* and 8*b*. The work machine 1 travels due to the rotations of the crawler belts 8*a* and 8*b*.

The work implement 3 is disposed in front of the vehicle body 2. The work implement 3 is supported so as to be swingable about a lift axis A1. The lift axis A1 extends in a left-right direction of the vehicle body 2. The work implement 3 includes a work tool 10 and a work implement frame 11. In the present embodiment, the work tool 10 is a blade. The work implement frame 11 supports the work tool 10. As illustrated in FIG. 2, the work implement frame 11 includes a first frame 12, a second frame 13, and a coupling portion 14.

The first frame 12 and the second frame 13 extend in a front-rear direction of the work machine 1. The first frame 12 and the second frame 13 are disposed apart from each other in the left-right direction. The first frame 12 and the second frame 13 are supported by the vehicle body 2 so as to be swingable about the lift axis A1. The coupling portion 14 couples the first frame 12 and the second frame 13. The coupling portion 14 is connected to the work tool 10. The first frame 12, the second frame 13, and the coupling portion 14 integrally swing about the lift axis A1.

The work implement 3 includes a plurality of actuators 15 and 16. The plurality of actuators 15 and 16 include a first lift actuator 15 and a second lift actuator 16. The first lift actuator 15 and the second lift actuator 16 are disposed apart from each other in the left-right direction of the work machine 1.

The first lift actuator 15 is connected to the vehicle body 2 and the first frame 12. The second lift actuator 16 is connected to the vehicle body 2 and the second frame 13. The first lift actuator 15 and the second lift actuator 16 are hydraulic cylinders. The first lift actuator 15 and the second lift actuator 16 cause the work implement frame 11 to swing up and down about the lift axis A1. As a result, the work implement 3 performs a lift motion up and down.

Figure 3:
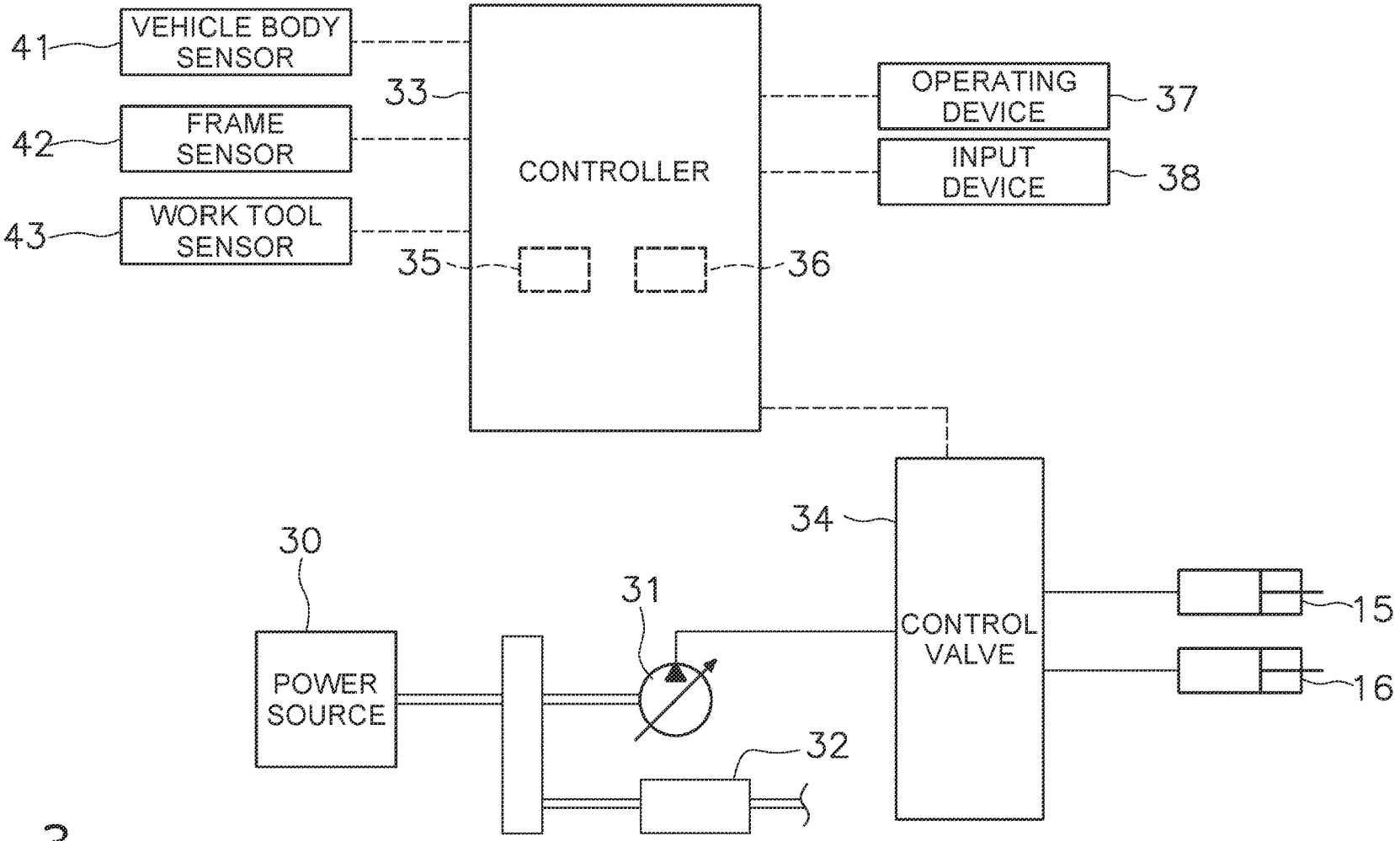
FIG. 3 is a block diagram illustrating a control system of the work machine.

FIG. 3 is a block diagram illustrating a configuration of a control system of the work machine 1. As illustrated in FIG. 3, the work machine 1 includes a power source 30, a hydraulic pump 31, and a power transmission device 32. The power source 30 is, for example, an internal combustion engine. However, the power source 30 may be an electric motor. Alternatively, the power source 30 may be a hybrid of an internal combustion engine and an electric motor.

The hydraulic pump 31 is driven by the power source 30 to discharge hydraulic fluid. The hydraulic fluid discharged from the hydraulic pump 31 is supplied to the lift actuators 15 and 16. Although one hydraulic pump 31 is illustrated in FIG. 3, a plurality of hydraulic pumps may be provided.

The power transmission device 32 transmits driving force of the power source 30 to the travel device 7. The power transmission device 32 may be, for example, a hydro static transmission (HST). Alternatively, the power transmission device 32 may be, for example, a transmission having a torque converter or a plurality of transmission gears.

The work machine 1 includes a controller 33 and a control valve 34. The controller 33 is programmed to control the work machine 1 based on acquired data. The controller 33 includes a storage device 35 and a processor 36. The processor 36 includes a CPU, for example. The storage device 35 includes a memory and an auxiliary storage device, for example. The storage device 35 may be a RAM or a ROM, for example. The storage device 35 may be a semiconductor memory, a hard disk, or the like. The storage device 35 is an example of a non-transitory computer-readable recording medium. The storage device 35 stores computer instructions that are executable by the processor 36 and for controlling the work machine 1.

The control valve 34 is controlled by a command signal from the controller 33. The control valve 34 is disposed between the hydraulic pump 31 and the lift actuators 15 and 16. The control valve 34 controls the flow rate of the hydraulic fluid supplied from the hydraulic pump 31 to the lift actuators 15 and 16.

The work machine 1 includes an operating device 37 and an input device 38. The operating device 37 includes a lever, for example. Alternatively, the operating device 37 may include a pedal or a switch. An operator can manually operate the travel of the work machine 1 and the motion of the work implement 3 using the operating device 37. For example, the operating device 37 is configured to operate the lift motion of the work implement 3. The operating device 37 outputs an operation signal indicative of an operation of the operating device 37. The controller 33 receives the operation signal from the operating device 37.

The input device 38 includes a touch screen, for example. The input device 38 may include another device such as a switch. The operator can set a control of the work machine 1 using the operating device 37. The input device 38 outputs an input signal indicative of an input to the input device 38. The controller 33 receives the input signal from the input device 38.

The work machine 1 includes a vehicle body sensor 41, a frame sensor 42, and a work tool sensor 43. The vehicle body sensor 41 is attached to the vehicle body 2. The vehicle body sensor 41 detects a posture of the vehicle body 2. The frame sensor 42 is attached to the work implement frame 11. The frame sensor 42 detects a posture of the work implement frame 11. The work tool sensor 43 is attached to the work implement 3. The work tool sensor 43 detects a posture of the work tool 10.

The vehicle body sensor 41 detects a pitch angle, a roll angle, and a yaw angle of the vehicle body 2. The frame sensor 42 detects a pitch angle, a roll angle, and a yaw angle of the work implement frame 11. The work tool sensor 43 detects a pitch angle, a roll angle, and a yaw angle of the work tool 10.

The vehicle body sensor 41, the frame sensor 42, and the work tool sensor 43 are, for example, acceleration sensors such as inertial measurement units (IMU). However, each of the vehicle body sensor 41, the frame sensor 42, and the work tool sensor 43 is not limited to the IMU and may be another acceleration sensor. Each of the sensors 41 to 43 detects the pitch angle and the roll angle by a gravitational acceleration. Further, each of the sensors 41 to 43 detects the yaw angle by integrating the angular velocity while the yaw angle at the time of start is defined as zero.

The controller 33 is communicably connected to the vehicle body sensor 41, the frame sensor 42, and the work tool sensor 43 by wire or wirelessly. The controller 33 acquires vehicle body posture data from the vehicle body sensor 41. The vehicle body posture data indicates the pitch angle, the roll angle, and the yaw angle of the vehicle body 2. The controller 33 acquires frame posture data from the frame sensor 42. The frame posture data indicates the pitch angle, the roll angle, and the yaw angle of the work implement frame 11. The controller 33 acquires work tool posture data from the work tool sensor 43. The work tool posture data indicates the pitch angle, the roll angle, and the yaw angle of the work tool 10.

The controller 33 controls the work machine 1 based on the vehicle body posture data, the frame posture data, and the work tool posture data. For example, the controller 33 calculates a position of the work tool 20 based on the vehicle body posture data, the frame posture data, and the work tool posture data. The controller 33 may control the control valve 34 so that the work tool 20 performs a desired operation based on the position of the work tool 20.

Figure 4:
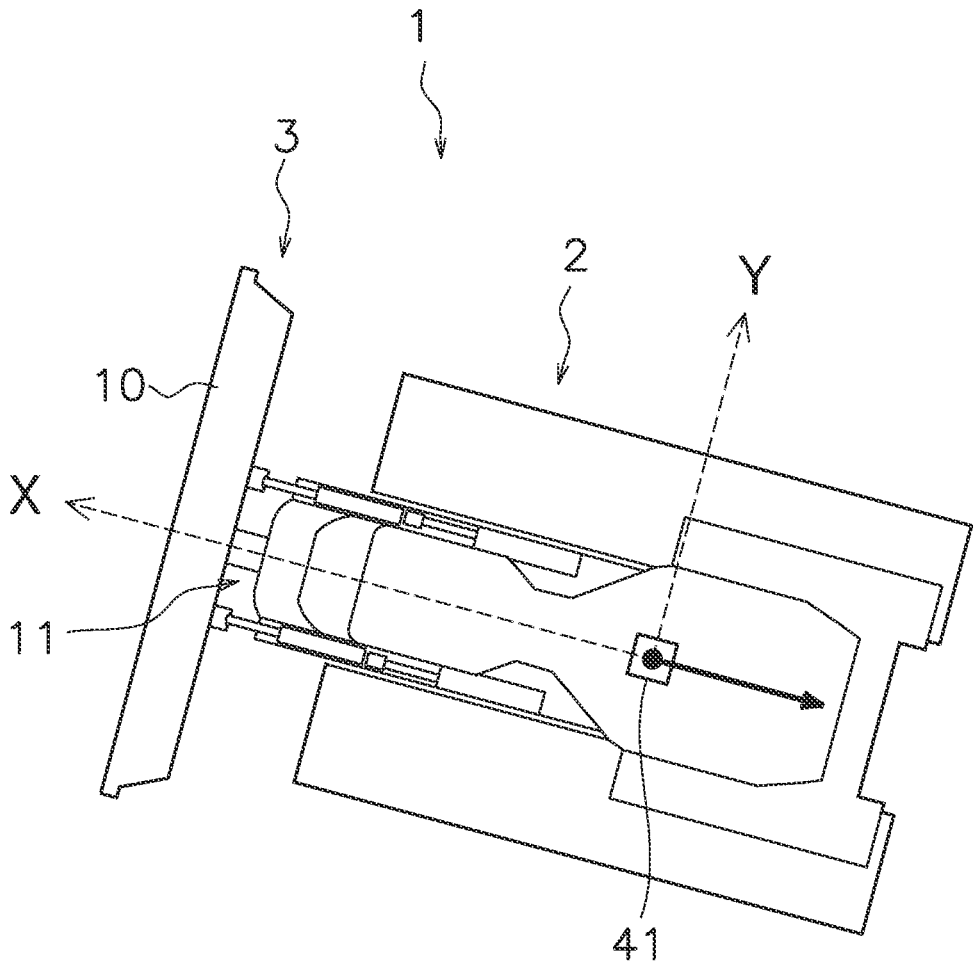
FIG. 4 is a schematic top view of the work machine with no yaw angle error in a vehicle body sensor.
Figure 5:
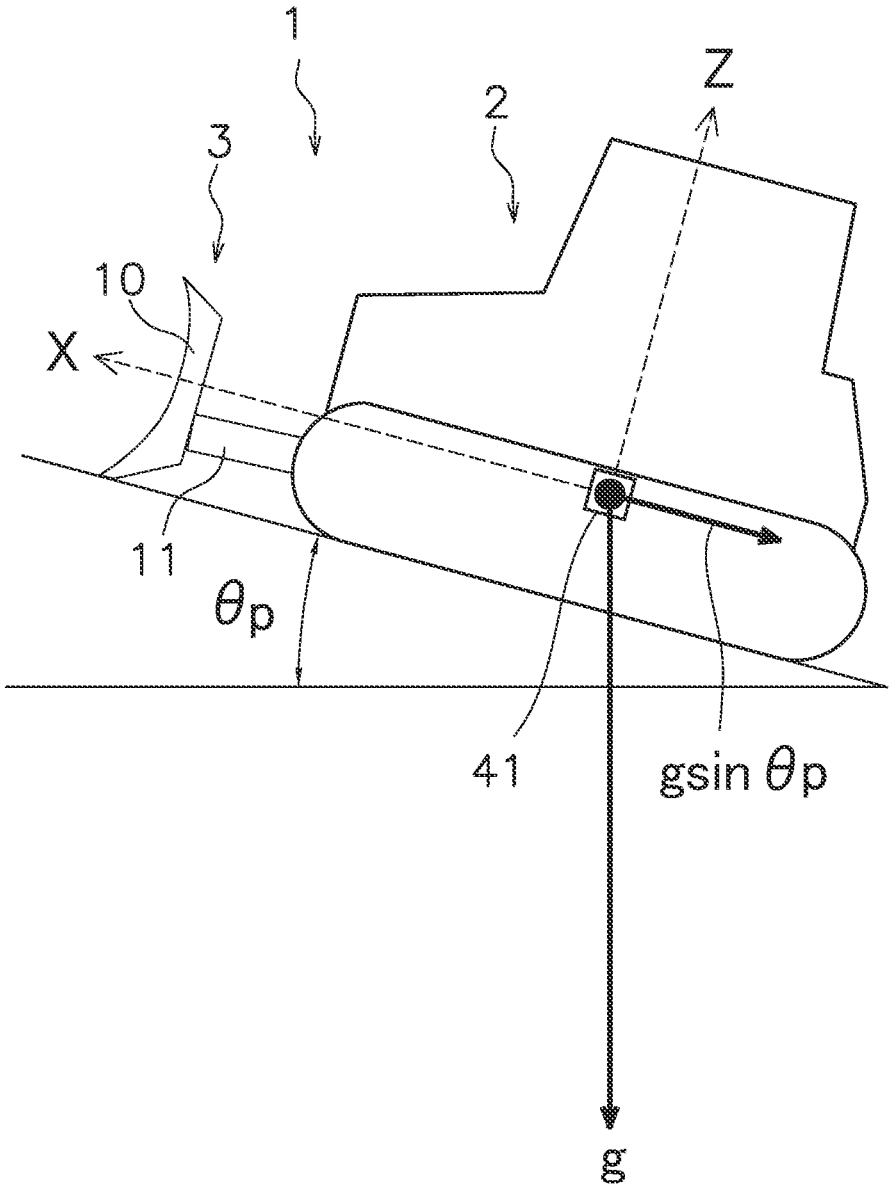
FIG. 5 is a schematic side view of the work machine illustrating a pitch angle of a vehicle body.
Figure 6:
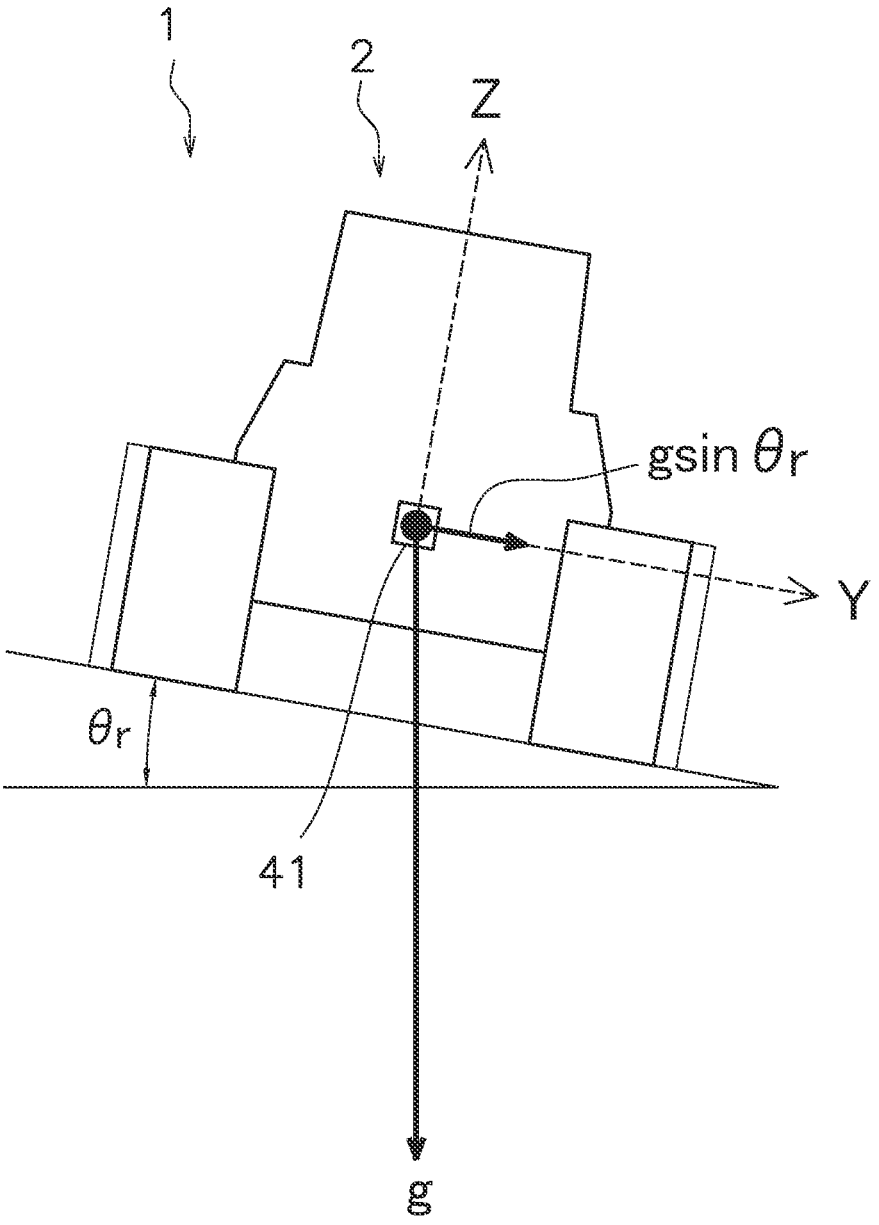
FIG. 6 is a schematic rear view of the work machine illustrating a roll angle of the vehicle body.

Next, a method for calibrating the vehicle body sensor 41 will be described. In a case where the vehicle body sensor 41 is attached to the vehicle body 2 in a correct orientation, an x-axis of the vehicle body sensor 41 matches a front direction of the vehicle body 2 as illustrated in FIG. 4. That is, a yaw angle error between the vehicle body sensor 41 and the vehicle body 2 is zero degrees. In this case, as illustrated in FIG. 5, when the vehicle body 2 is tilted at a pitch angle $\theta p$, the vehicle body sensor 41 detects the pitch angle $\theta p$ with an x component $g \sin \theta p$ of a gravitational acceleration g. Further, as illustrated in FIG. 6, when the vehicle body 2 is tilted at a roll angle $\theta r$, the vehicle body sensor 41 detects the roll angle $\theta r$ with a y component $g \sin \theta r$ of the gravitational acceleration g. Note that in the drawings, X, Y, and Z indicate the x-axis, the y-axis, and the z-axis of the vehicle body sensor 41, respectively.

Figure 7:
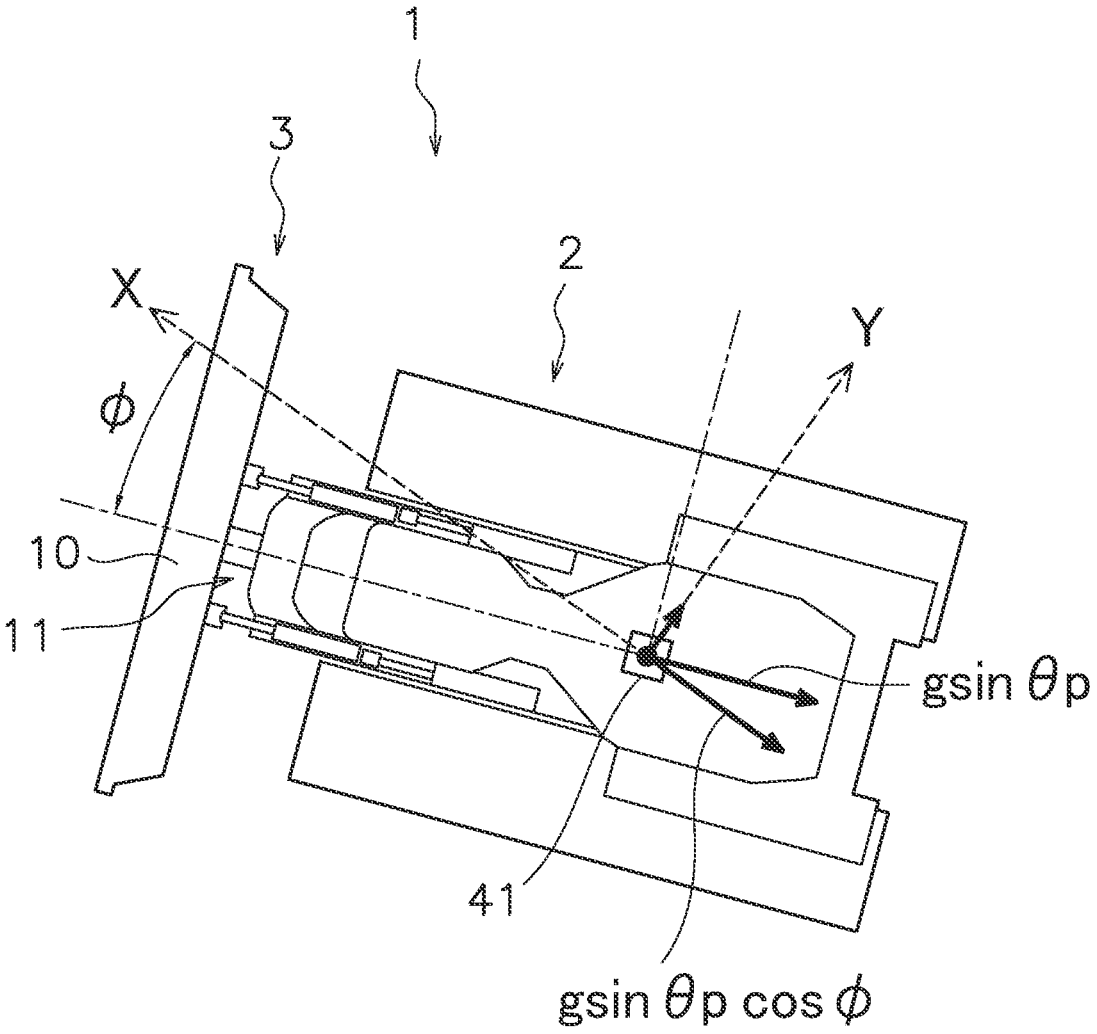
FIG. 7 is a schematic top view of the work machine with a yaw angle error in the vehicle body sensor.

However, as illustrated in FIG. 7, the x-axis of the vehicle body sensor 41 may deviate from the front direction of the vehicle body 2. In this case, assuming that the yaw angle error between the x axis of the vehicle body sensor 41 and the front direction of the vehicle body 2 is $\varphi$, the vehicle body sensor 41 detects an x component $g \sin \theta p \cos \varphi$ of the gravitational acceleration g. However, this value is less than $g \sin \theta p$ that is indicative of an appropriate pitch angle of the vehicle body 2. This results in an error in the pitch angle of the vehicle body 2 detected by the vehicle body sensor 41.

Figure 8:
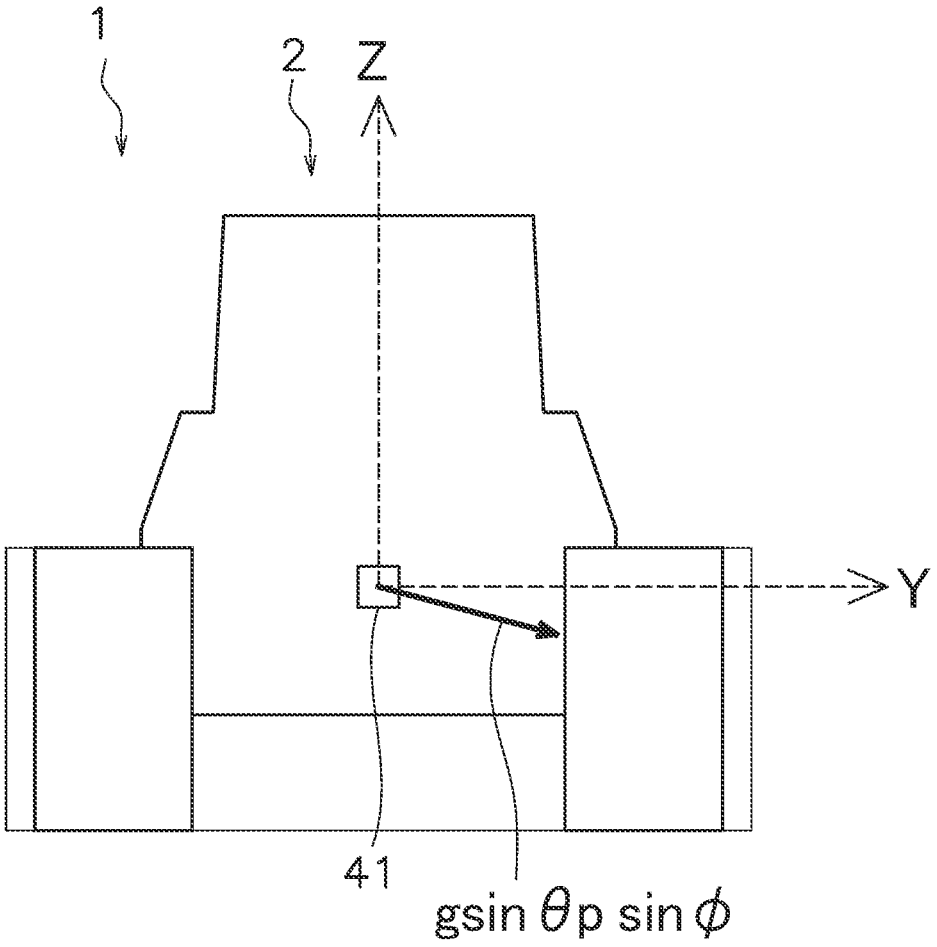
FIG. 8 is a schematic rear view of the work machine with a yaw angle error in the vehicle body sensor.

Moreover, in this case, the vehicle body sensor 41 detects a y component $g \sin \theta p \sin \varphi$ of the gravitational acceleration g as illustrated in FIG. 8, even if the roll angle of the vehicle body 2 is zero. This results in an error in the roll angle of the vehicle body 2 detected by the vehicle body sensor 41. Assuming an error in the roll angle is B, the following formula (1) is satisfied.

$$g \sin \theta p \sin \varphi = g \sin \beta \quad (1)$$

The controller 33 calculates a yaw angle error $\varphi$ by the following formula (2).

$$\Phi = \sin^{-1}(\sin(\theta r - \theta R)/\sin \theta p) \quad (2)$$

$\theta R$ is a roll angle of the work implement frame 11 detected by the frame sensor 42. That is, the controller 33 calculates the yaw angle error $\varphi$ of the vehicle body sensor 41 with respect to the vehicle body 2 based on the pitch angle of the vehicle body 2 and a difference between the roll angle of the vehicle body 2 and the roll angle of the work implement frame 11. The controller 33 calibrates the pitch angle, the roll angle, and the yaw angle detected by the vehicle body sensor 41 using the yaw angle error $\varphi$ of the vehicle body sensor 41.

It is assumed that the roll angle and the pitch angle detected by the vehicle body sensor 41 have been calibrated. Further, it is assumed that the roll angle, the pitch angle, and the yaw angle detected by the frame sensor 42 have been calibrated.

The work implement frame 11 is attached so as to be impossible to rotate about a roll axis with respect to the vehicle body 2. The roll axis extends in the front-rear direction of the vehicle body 2. Therefore, the roll angle of the work implement frame 11 matches the roll angle of the vehicle body 2. In the above formula (2), the roll angle $\theta R$ of the work implement frame 11 is used as a correct roll angle of the vehicle body 2, whereby the yaw angle error $\varphi$ of the vehicle body sensor 41 with respect to the vehicle body 2 is calculated based on the error in the roll angle of the vehicle body 2 and the pitch angle of the vehicle body 2.

In the control system of the work machine 1 according to the present embodiment described above, the yaw angle error $\varphi$ of the vehicle body sensor 41 is calculated using the difference between the roll angle of the work implement frame 11 detected by the frame sensor 42 and the roll angle of the vehicle body 2 detected by the vehicle body sensor 41. As a result, the vehicle body sensor 41 can be accurately calibrated even on a slope whose inclination angle is unknown or even if the front direction of the vehicle body 2 is not exactly aligned with the direction of the slope. Therefore, in the control system according to the present embodiment, restrictions on equipment for performing calibration can be reduced. Also, the time for calibration can be reduced.

Although one embodiment of the present invention has been described above, the present invention is not limited to the above embodiment and various changes can be made without departing from the gist of the invention.

The work machine 1 is not limited to a bulldozer and may be another vehicle such as a wheel loader, a motor grader, or the like. In the above embodiment, the work implement frame 11 is disposed inward of the crawler belts 8*a* and 8*b*. However, the work implement frame 11 may be disposed outward of the crawler belts 8*a* and 8*b*.

The controller 33 may include a plurality of controllers separate from each other. The work machine 1 may be remotely operated. In this case, the controller 33, the operating device 37, and the input device 38 may be disposed outside of the work machine 1. The controller 33 may control the work machine 1 by performing wireless communication with the work machine 1.

The processes by the controller 33 are not limited to those of the above embodiment and may be changed. A portion of the processes by the controller 33 may be omitted. Alternatively, a portion of the processes described above may be changed.

For example, the work implement sensor may be the work tool sensor 43 instead of the frame sensor 42. That is, the controller 33 may calculate the yaw angle error φ of the vehicle body sensor 41 with respect to the vehicle body 2 based on the pitch angle of the vehicle body 2 and a difference between the roll angle of the vehicle body 2 and the roll angle of the work tool 10.

In the above embodiment, it is assumed that the frame sensor 42 has been calibrated. However, the controller 33 may calibrate the yaw angle of the frame sensor 42 by a following method. The controller 33 may calculate a yaw angle error of the frame sensor 42 with respect to the work implement frame 11 so that a change in the roll angle of the work implement frame 11 is zero while causing the work implement frame 11 to swing about the lift axis A1. The controller 33 may calibrate the frame sensor 42 using the yaw angle error of the frame sensor 42.

When the yaw angle error of the frame sensor 42 is zero, the roll angle of the work implement 3 does not change, although the pitch angle of the work implement 3 changes according to the lift motion of the work implement 3. Therefore, the controller 33 can calculate, as the yaw angle error, the yaw angle of the frame sensor 42 at which the roll angle of the work implement 3 is zero even if the work implement 3 performs the lift motion. In this way, the yaw angle error of the frame sensor 42 can be easily and accurately calculated due to the lift motion of the work implement 3.

According to the present invention, a system and a method for controlling a work machine are provided which are capable of reducing restrictions on equipment and the time for performing calibration.

The invention claimed is:

1. A system for controlling a work machine, the work machine including a vehicle body and a work implement supported by the vehicle body, the system comprising:

a vehicle body sensor attached to the vehicle body, the vehicle body sensor being configured to detect a roll angle, a pitch angle, and a yaw angle of the vehicle body;

a work implement sensor attached to the work implement, the work implement sensor being configured to detect a roll angle of the work implement; and a controller configured to be communicably connected to the vehicle body sensor and the work implement sensor, the controller being configured to acquire the roll angle and the pitch angle of the vehicle body detected by the vehicle body sensor, acquire the roll angle of the work implement detected by the work implement sensor, calculate a yaw angle error of the vehicle body sensor with respect to the vehicle body based on the pitch angle of the vehicle body and a difference between the roll angle of the vehicle body and the roll angle of the work implement, and calibrate the vehicle body sensor using the yaw angle error of the vehicle body sensor.

2. The system according to claim 1, wherein the work implement is supported so as to be swingable about a lift axis extending in a left-right direction of the vehicle body.

3. The system according to claim 2, wherein the controller is further configured to calculate a yaw angle error of the work implement sensor with respect to the work implement so that a change in the roll angle of the work implement is zero while causing the work implement to swing about the lift axis, and calibrate the work implement sensor using the yaw angle error of the work implement sensor.

4. A method performed by a controller configured to control a work machine including a vehicle body, a work implement supported by the vehicle body, a vehicle body sensor attached to the vehicle body, the vehicle body sensor being configured to detect a roll angle, a pitch angle, and a yaw angle of the vehicle body, and a work implement sensor attached to the work implement, the work implement sensor being configured to detect a roll angle of the work implement, the method comprising:

acquiring the roll angle and the pitch angle of the vehicle body detected by the vehicle body sensor;

acquiring the roll angle of the work implement detected by the work implement sensor;

calculating a yaw angle error of the vehicle body sensor with respect to the vehicle body based on the pitch angle of the vehicle body and a difference between the roll angle of the vehicle body and the roll angle of the work implement; and calibrating the vehicle body sensor using the yaw angle error of the vehicle body sensor.

5. The method according to claim 4, wherein the work implement is supported so as to be swingable about a lift axis extending in a left-right direction of the vehicle body.

6. The method according to claim 5, further comprising:

calculating a yaw angle error of the work implement sensor with respect to the work implement so that a change in the roll angle of the work implement is zero while causing the work implement to swing about the lift axis; and calibrating the work implement sensor using the yaw angle error of the work implement sensor.

* * * * *